US006397616B2

(12) United States Patent
Yamasaki et al.

(10) Patent No.: US 6,397,616 B2
(45) Date of Patent: Jun. 4, 2002

(54) PRESSURE REDUCER AND REFRIGERATING CYCLE UNIT USING THE SAME

(75) Inventors: Kurato Yamasaki, Kariya; Shigeki Ito, Okazaki; Teruyuki Hotta, Nagoya; Yasushi Yamanaka, Nakashima-gun; Atsushi Inaba, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/827,069

(22) Filed: Apr. 5, 2001

(30) Foreign Application Priority Data

| | | |
|---|---|---|
| Apr. 6, 2000 | (JP) | 2000-105276 |
| Jun. 23, 2000 | (JP) | 2000-189600 |
| Nov. 6, 2000 | (JP) | 2000-337838 |

(51) Int. Cl.[7] ..... F25B 41/06
(52) U.S. Cl. ..... 62/244; 62/527
(58) Field of Search ..... 62/244, 511, 527, 62/528; 138/44, 45

(56) References Cited

U.S. PATENT DOCUMENTS

| | | | | |
|---|---|---|---|---|
| 3,311,131 A | * | 3/1967 | Zahuranec | 138/44 |
| 3,741,242 A | | 6/1973 | Hansen et al. | |
| 4,009,592 A | | 3/1977 | Boerger | |
| 4,324,112 A | | 4/1982 | Fujiwara et al. | |
| 4,375,228 A | | 3/1983 | Widdowson | |
| 5,715,704 A | * | 2/1998 | Cholkeri et al. | 137/513.3 |
| 5,966,960 A | * | 10/1999 | Cummings et al. | 138/44 |
| 6,182,457 B1 | * | 2/2001 | Enderle | 137/513.3 |

FOREIGN PATENT DOCUMENTS

| | | |
|---|---|---|
| EP | 0987 505 | 3/2000 |
| EP | 1150076 A2 | 10/2001 |
| JP | 11-257802 | 9/1999 |

* cited by examiner

*Primary Examiner*—William E. Tapolcai
(74) *Attorney, Agent, or Firm*—Harness, Dickey & Pierce, PLC

(57) ABSTRACT

A variable restrict valve is disposed at the upstream side of a refrigerant flow, a fixed restrictor is disposed at the downstream side of the variable restrict valve, an intermediate space is provided between the variable restrict valve and the fixed restrictor, a passage sectional area of the intermediate space is set to be larger than the fixed restrictor and passage length L of the intermediate space is set to be larger than a predetermined length required when the flow of refrigerant injected from the variable restrict valve expands more than the passage sectional area of the fixed restrictor.

14 Claims, 14 Drawing Sheets

PRESSURE REDUCER AND REFRIGERATING CYCLE UNIT USING THE SAME

CROSS REFERENCE TO RELATED APPLICATION

This application is based on and incorporates herein by reference Japanese Patent Application Nos. 2000-105276 filed on Apr. 6, 2000, 2000-189600 filed on Jun. 23, 2000, and 2000-337838 filed on Nov. 6, 2000.

BACKGROUND OF THE INVENTION

1. Field of the Invention

The present invention relates to a pressure reducer in a refrigeration cycle unit suitable for use in a vehicle air-conditioner.

2. Description of Related Art

A temperature type pressure reducer has been normally used as a pressure reducer to automatically control the flow rate of refrigerant so that the degree of superheat of refrigerant at the output of an evaporator is maintained at a predetermined value because the width of fluctuations of cycle operating condition is large in a vehicular air-conditioning refrigeration cycle unit. However, the structure of the temperature pressure reducer is complicated and is expensive because it requires a valve driving mechanism which operates corresponding to the degree of superheat of the refrigerant at the output of the evaporator.

Then, there has been proposed a pressure reducer having a simple structure by eliminating the valve driving mechanism in JP-A-11-257802. In this prior art, a pressure reducer having a valve mechanism for changing a restrict diameter corresponding to differential pressure (difference between high pressure and low pressure of the cycle) before and after the pressure reducer is constructed as shown in FIG. 22 in a refrigeration cycle unit. In the accumulator type refrigeration cycle unit, an accumulator for collecting liquid refrigerant by separating gas and liquid of the refrigerant is disposed between the outlet of the evaporator and the suction side of the compressor.

According to the prior art, the valve mechanism expands the restrict diameter when the circulating flow rate of the cycling refrigerant is balanced with the radiating capability of the condenser and the differential pressure is smaller than a first predetermined value P1 in running normally for example. Then, the valve mechanism reduces the restrict diameter when the radiating capability of the condenser drops due to the reduction of the cooling air amount and the high pressure increases, thus increasing the differential pressure more than the first predetermined value P1 in idling. Then, the valve mechanism expands the restrict diameter again when the flow rate of the cycling refrigerant rises remarkably due to the high-speed rotation of the compressor in running at high-speed for example and the high pressure rises further, thereby increasing the differential pressure more than a second predetermined value P2.

Thus, the valve mechanism lowers the low pressure by reducing the restrict diameter in idling to assure the cooling capability in idling and expands the restrict diameter in running at high-speed to prevent the high pressure from rising abnormally in the prior art.

However, the actual relationship between the refrigeration cycle operating condition and the differential pressure (difference of high pressure and low pressure in the cycle) before and after the pressure reducer is not determined uniquely as shown in FIG. 22. For instance, there is a case when the high pressure rises and the differential pressure becomes greater than the second predetermined value P2 when the radiating capability of the condenser drops extremely even in idling when the outside temperature is high or when the traffic jam occurs in a city and the valve mechanism expands the restrict diameter similarly to the case of running at high-speed. As a result, there arise problems that the low pressure (refrigerant evaporating temperature) rises and the subcooling degree of the refrigerant at the outlet of the condenser reduces, thereby dropping the cooling capability.

A vehicular transmission gear is shifted to low-speed gear and the flow rate of the cycling refrigerant rises remarkably due to the high-speed rotation of the compressor in running an uphill road even in running normally. However, since the car speed is low in running the uphill road, it is often unable to obtain the cooling air amount of the condenser corresponding to the rise of the flow rate of the refrigerant. As a result, there is a case when the high pressure rises and the differential pressure becomes greater than the first predetermined value P1 as the radiating capability of the condenser becomes insufficient. The valve mechanism reduces the restrict diameter similarly to the case in idling at this time. Thereby, the high pressure rises further, thereby increasing the driving power of the compressor and worsening the efficiency of the cycle.

SUMMARY OF THE INVENTION

In view of the problems described above, an object of the present invention is to provide a pressure reducer having the small and simple structure and capable of controlling the flow rate of refrigerant favorably even when the operating condition fluctuates widely.

In the accumulator type refrigeration cycle unit in which an accumulator for collecting liquid refrigerant by separating the gas and liquid of the refrigerant is disposed between the outlet of the condenser and the intake side of the compressor as disclosed in JP-A-11-257802, saturated gas refrigerant is taken in from the accumulator and is compressed and discharged. Then, the condition (subcooling degree or dryness) of the refrigerant at the outlet of the condenser changes due to the fluctuations of the cycle operating condition. It is effective to maintain the subcooling degree of the refrigerant at the outlet of the condenser in an adequate range (around 7–15° C.) in order to improve the efficiency of the refrigeration cycle.

That is, when the subcooling degree of the refrigerant at the outlet of the condenser becomes excessively large, the driving power of the compressor increases due to the rise of the high pressure. When the subcooling degree of the refrigerant at the outlet of the condenser becomes excessively small in contrary, the difference of enthalpy between the inlet and outlet of the evaporator decreases, thus dropping the capability.

Then, the present invention achieves the above-mentioned object by favorably controlling the flow rate of refrigerant with respect to the wide fluctuations of the driving condition while maintaining the subcooling degree of the refrigerant at the outlet of the condenser in the appropriate range.

According to a first aspect of the present invention, variable restrict means is disposed at the upstream side of flow of the refrigerant. Fixed restrict means is disposed at the downstream side of the variable restrict means, and refrigerant which has passed through the variable restrict means always flows thereto. An intermediate space is provided between said variable restrict means and the fixed restrict means, and passage sectional area of which is larger than that of the fixed restrict means. The length of the intermediate space is larger than a predetermined length required for allowing the refrigerant injected out of the variable restrict means to expand more than a passage sectional area of the fixed restrict means.

The fixed restrict means has the shape of a nozzle or the like. The change of flow rate is large, i.e., a flow rate control gain is large, in the area B where the dryness of refrigerant is small (dryness $x<0.1$ for example) as indicated by a dot chain line (1) in FIG. 3 described later.

Then, noticing on this point, the variable restrict means disposed at the upstream side of the flow of refrigerant decompresses the subcool liquid refrigerant at the outlet of the condenser by a predetermined degree to change to the small dryness area, the gas-liquid two phase refrigerant in the small dryness area is flown into the fixed restrict means to decompress again.

Thereby, the refrigerant flow rate control action can be performed in the refrigerant state in which the flow rate control gain is large by the fixed restrict means, so that a large refrigerant flow rate control width D (FIG. 5) can be obtained by a small variation width C of the subcooling degree as indicated by (2) in FIGS. 3 and 5 when the flow rate control action of the fixed restrict means is seen from the relationship with the subcooling degree of the refrigerant at the outlet of the condenser.

Specifically, because the restrict means at the upstream side of the flow of refrigerant is the variable restrict means whose throttle opening can be controlled, an adequate dryness state may be created by the flow rate control action of the fixed restrict means at the downstream side by controlling the throttle opening of the variable restrict means corresponding to the changes of state of the refrigerant at the outlet of the condenser.

Further, the part of the flow of refrigerant where the flow velocity is high and the part thereof where the flow velocity is low may be mixed in the intermediate space by injecting the refrigerant in the small dryness area decompressed by the variable restrict means to the intermediate space where the passage sectional area is larger than that of the fixed restrict means and by expanding the flow of injected refrigerant more than the passage sectional area of the fixed restrict means within the intermediate space. Therefore, the injected flow of refrigerant from the variable restrict means (14) can be a flow of relatively uniform flow velocity and this uniform flow of refrigerant may be restricted steadily according to the flow rate characteristic of the fixed restrict means at the downstream side. The flow rate characteristics indicated by (1) in FIG. 3 may be exhibited steadily by the restricting action of the fixed restrict means.

As a result, the refrigerant flow rate may be controlled in the wide range by the small variation width of the subcooling degree of the refrigerant at the outlet of the condenser even when the refrigeration cycle operating condition fluctuates widely. Therefore, the subcooling degree of the refrigerant at the outlet of the condenser may be kept in an adequately range for improving the efficiency of the cyclic operation, thereby achieving the highly efficient cyclic operation and the assurance of the cooling performance. Further, because it requires no valve driving mechanism which corresponds to the degree of superheat such as temperature type pressure reducer and the small and simple pressure reducer comprising the variable restrict means and the fixed restrict means may be constructed.

According to a second aspect of the present invention the pressure reducer includes bleeding means for allowing the intermediate space to communicate with an upstream side passage of the variable restrict means even when the variable restrict means is closed.

It allows the refrigerant to be flown through the bleeding means even when the variable restrict means is closed, so that it is possible to prevent the variable restrict means from hunting when the flow rate is small while closing the variable restrict means until when the refrigerant flow rate increases to a predetermined flow rate.

According to a third aspect of the present invention, the variable restrict means has a fixed valve seat and a valve body displacing with respect to the fixed valve seat. The valve body displaces in accordance with a pressure difference between at an upstream side and a downstream side thereof.

Thereby, it is possible to keep the pressure difference at a constant value regardless of the fluctuations of the operating condition and to maintain the flow rate control action of the fixed restrict means at the downstream side in a favorable state at all times by changing the subcool liquid refrigerant at the outlet of the condenser to the small dryness area by the variable restrict means.

According to a fourth aspect of the present invention, the pressure reducer includes spring means for urging the valve body toward a valve closing direction against the pressure difference, and the spring force of the spring means is adjustable.

Thereby, the pressure difference may be controlled by setting the spring force of the spring means and the target subcooling degree of the refrigerant at the outlet of the condenser may be readily controlled by controlling the pressure difference. Accordingly, the target subcooling degree may be controlled readily by controlling the spring force of the spring means even when heat exchanging capability is difference due to the change of size of the condenser and the evaporator and when the heat radiating condition of the condenser is changed.

According to a fifth aspect of the present invention, the pressure reducer includes a body member for containing the variable restrict means. The fixed valve seat is assembled to the body member so that its position can be adjusted and the spring force of the spring means is adjusted by adjusting the position of the fixed valve seat.

Thereby, the target subcooling degree may be adjusted readily by adjusting the position of the fixed valve seat with respect to the body member.

According to a sixth aspect of the present invention, the pressure the spring force of the spring means is preset at 3–5 $kg/cm^2$.

According to the experiments and study conducted by the inventors, it was found that the subcooling degree of the refrigerant at the outlet of the condenser may be set at the optimum range for improving the efficiency of the cyclic operation and for assuring the cooling performance and that the favorable flow rate control characteristics which allows the refrigerant flow rate to be largely changed by the small variation of the subcooling degree may be obtained by setting the spring preset pressure within that range.

According to a seventh aspect of the present invention, the variable restrict means has a restrict passage formed into a shape such that the refrigerant having contracted at an inlet thereof adheres to an inner wall surface of the intermediate space to be decompressed by tubular friction.

Since the tubular frictional force has the relationship that it is proportional to the square of the flow velocity, it is possible to increase the opening of the variable restrict means by utilizing that the tubular frictional force increases when the flow rate is high. It also allows the action of keeping the pressure difference constant regardless of the fluctuations of flow rate to be enhanced further, thus maintaining the good refrigerant flow rate characteristics (flow rate control gain).

According to an eighth aspect of the present invention, length L2 of the restrict passage and an equivalent diameter d2 of the restrict passage satisfy a relation $L2/d2 \geqq 5$.

According to the study conducted by the inventors, it was found that the operation and effect of the eighth aspect of the present invention can be obtained when the shape of the restrict passage is set so that the above-mentioned ratio becomes $L2/d2>5$ in concrete because the decompression effect by the tubular friction in the restrict passage is favorably exhibited.

It is noted that the equivalent diameter means that when the cross sectional shape of the restrict passage is a normal circle, the diameter of the circle is applied as it is and when it is non-circle such as ellipse, it is replaced to a circle of the equal cross sectional area and the diameter of the replaced circle is applied.

According to a ninth aspect of the present invention, it is possible to catch foreign materials within the refrigerant at the upstream side of the variable restrict means and to prevent the small passage section of the pressure reducer from clogging by the foreign materials by disposing a filter at the upstream side of the variable restrict means.

According to a tenth aspect of the present invention, the fixed valve seat is disposed at the upstream side of the valve body and the filtering is assembled in a body with the fixed valve seat.

Thus, the filter may be formed in a body with the fixed valve seat of the variable restrict means, thereby decreasing a number of parts.

According to an eleventh aspect of the present invention, the whole pressure reducer may be constructed as a thin and long cylinder by containing the variable restrict means and the fixed restrict means linearly on a same axial line within a cylindrical body member. Accordingly, the pressure reducer may be disposed readily on the way of cooling pipes even in a very small mounting space such as a vehicular engine room.

According to a twelfth aspect of the invention, a refrigeration cycle unit comprises a compressor for compressing and discharging refrigerant, a condenser for condensing the refrigerant from the compressor, a pressure reducer for decompressing the refrigerant from the condenser, an evaporator for evaporating the refrigerant which has been decompressed by the pressure reducer, and an accumulator for storing the refrigerant from the evaporator. The pressure reducer is composed of the pressure reducer described above.

The invention can exhibit the refrigerant flow rate control action effectively in such accumulator type refrigeration cycle unit.

According to a thirteenth aspect of the present invention, the compressor is driven by a vehicular engine, the condenser is disposed at the region where it is cooled by receiving running wind in running the vehicle and the evaporator cools air blown out to a car room.

Although the state (subcooling degree) of the refrigerant at the outlet of the condenser is inclined to change largely due to the fluctuations of rotational speed of the compressor, to the fluctuations of radiating capability of the condenser caused by the fluctuations of car velocity and to the fluctuations of cooling thermal load of the evaporator in the vehicular accumulator type refrigeration cycle unit, the present invention allows the refrigerant flow rate to be favorably controlled and the subcooling degree of the refrigerant at the outlet of the condenser to be maintained in the adequate range even when the operating conditions fluctuate as described above.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 1:
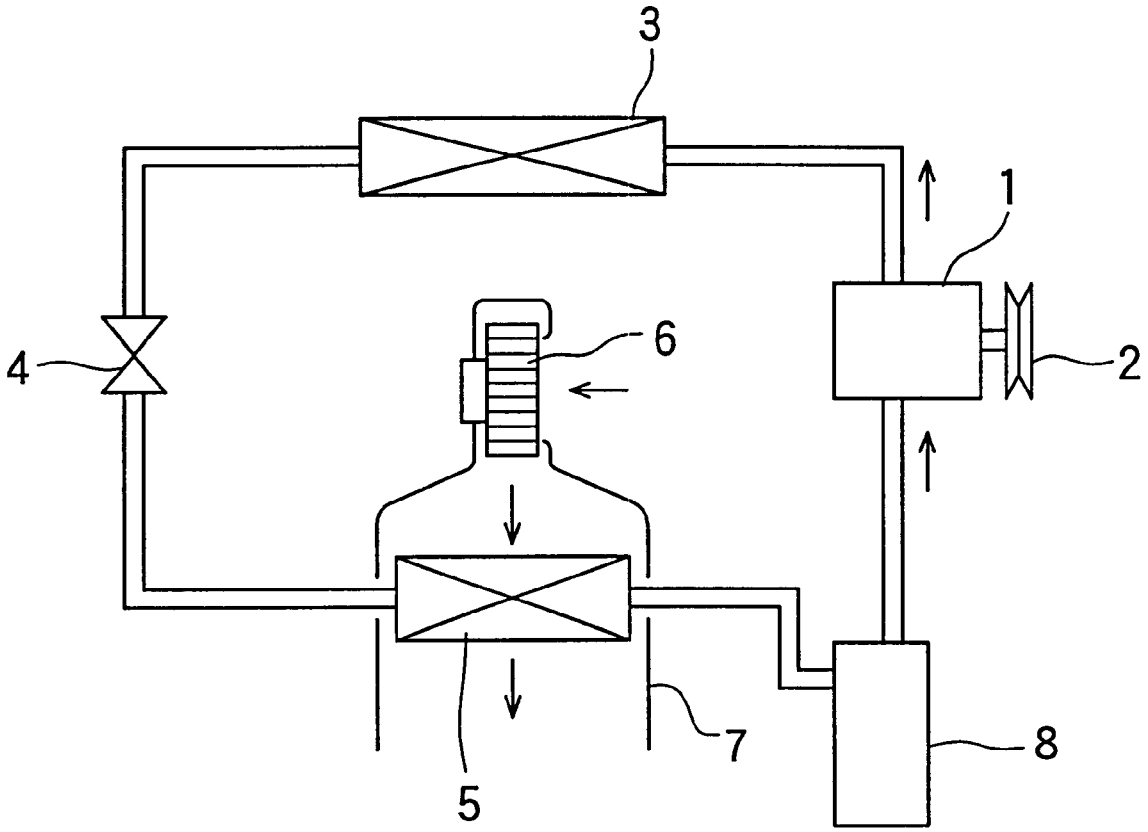
FIG. 1 is a schematic view showing a refrigeration cycle (first embodiment)

FIG. 1 shows a refrigeration cycle of vehicular air-conditioning system according to a first embodiment, wherein a compressor 1 is driven by a vehicular engine not shown via an electromagnetic clutch 2. High pressure gas refrigerant discharged out of the compressor 1 flows into a condenser 3 and is cooled and condensed through heat exchange with the outside air. It is noted that the condenser 3 is disposed at the region, e.g., the front most part within the vehicular engine room in concrete, where it is cooled by receiving running wind in running the vehicle. It is cooled by the running wind and by air blown by a condenser cooling fan.

Then, the liquid refrigerant condensed by the condenser 3 is then decompressed by an pressure reducer 4 to low pressure and is put into the misty gas-liquid two phase state. The pressure reducer 4 is what a plurality of steps of throttle means are disposed in the direction of flow of the refrigerant and its detail will be described later. The low-pressure refrigerant which has passed through the pressure reducer 4 evaporates in an evaporator 5 by absorbing heat from air blown from an air-conditioning fan 6.

The evaporator 5 is disposed within an air-conditioning case 7 and cold air which has been cooled by the evaporator 5 and whose temperature has been controlled by a heater core section not shown is then blown out to a car room as is well known. The gas refrigerant which has passed through the evaporator 5 is suctioned to the compressor 1 after when an accumulator 8 separates the gas from the liquid.

The accumulator 8 separates the liquid refrigerant from the refrigerant at the outlet of the evaporator 5 to collect the liquid refrigerant, and allows the compressor 1 to suction the gas refrigerant and oil melting in the liquid refrigerant collected at the bottom side of a tank.

Figure 2A:
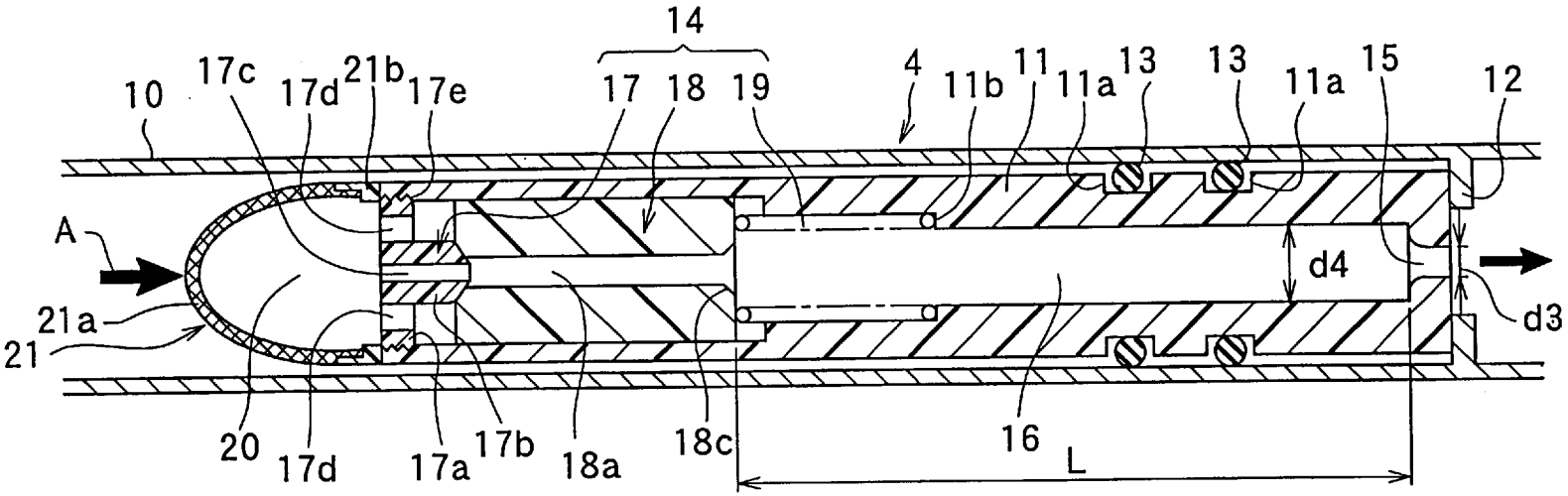
FIG. 2A is a cross-sectional view showing a pressure reducer (first embodiment)

FIG. 2A illustrates the structure of the pressure reducer 4 of the first embodiment, wherein a refrigerant pipe 10 is disposed between the outlet side of the condenser 3 and the inlet side of the evaporator 5 and is usually formed of metal such as aluminum. A body 11 of the pressure reducer 4 is built inside of the refrigerant pipe 10. This body 11 is molded approximately in a cylindrical shape by resin for example and is positioned by a stopper 12 within the refrigerant pipe 10.

Sealing O-rings 13 are held in concave grooves 11*a* at the outer peripheral surface of the body 11. The body 11 is held at the position determined by the stopper section 12 by press-fitting the O-rings 13 into the inner wall surface of the refrigerant pipe 10.

The pressure reducer 4 is constructed within the body member 11 and includes the following three elements. The first one is a variable restrict valve 14 disposed at the upstream side of the flowing direction A of the refrigerant, the second one is a fixed restrictor 15 disposed at the downstream side of the variable restrict valve 14, and the third one is an intermediate space (approach space) 16 provided between the variable restrict valve 14 and the fixed throttle 15.

The variable restrict valve 14 has a fixed valve seat 17, a valve body 18 which is displaceable with respect to the fixed valve seat 17 and a coil spring 19 for effecting spring force to the valve body 18 in the valve closing direction. The fixed valve seat 17 and the valve body 18 are molded by resin and the coil spring 19 is made of metallic spring member.

The fixed valve seat 17 has a disc portion 17*a* and a cylindrical portion 17*b* formed in a body with the center part of the disc portion 17*a*. A small bleed port 17*c* is formed at the center of the cylindrical portion 17*b*. This bleed port 17*c* composes communicating means for always communicating the intermediate space 16 with an upstream passage 20 of the variable restrict valve 14 with a small opening even when the variable restrict valve 14 is closed as shown in FIG. 2A. The diameter d1 of the bleed port 17*c* is as small as $\phi$1.0 mm for example.

The disc portion 17*a* has bypass ports 17*d* around the cylindrical portion 17*b*. The bypass ports 17*d* is divided into a plurality of ports around the cylindrical portion 17*b* in the shapes of arc, circle and the like. The plurality of bypass ports 17*d* allow an enough amount of refrigerant to flow by bypassing the bleed port 17*c* when the variable restrict valve 14 is opened (see FIG. 2B). The total opening cross sectional area of the plurality of bypassing ports 17*d* is set to be as large as several times or more of the opening cross sectional area of the bleed port 17*c*.

A thread 17*e* is created at the outer peripheral surface of the disc portion 17*a* so as to fasten and fix the disc portion 17*a* to the inner peripheral surface of the upstream side end of the body 11. Here, the disc portion 17*a* may be mechanically fixed to the body 11 by using other fixing means instead of fastening and fixing by the thread 17*e*.

The valve body 18 is a cylinder wherein a restrict passage 18*a* formed of a circular hole of small diameter is formed at the center thereof. The diameter d2 of the restrict passage 18*a* is greater than the diameter d1 of the bleed port 17*c* and is around $\phi$1.8 mm for example. An inclined concave face (upstream end) 18*b* which press-contacts with an edge inclined face 17*f* of the cylindrical portion 17*b* is formed at the upstream side end of the valve body 18.

Accordingly, the opening area of the inlet section of the restrict passage 18*a* may be controlled by changing the gap between the edge inclined face 17*f* of the cylindrical portion 17*b* and the inclined concave face 18*b* of the upstream side end of the valve body 18. An enlarged opening portion 18*c* whose opening cross sectional area is enlarged gradually is formed at the downstream side end of the restrict passage 18*a*. The enlarged opening portion 18*c* reduces a sudden enlargement loss of flow of the refrigerant flown out of the outlet section of the restrict passage 18*a*.

One end of the coil spring 19 abuts against the downstream side end face of the valve body 18 and the other end is supported to a stepped face 11*b* formed at the inner peripheral face of the body 11. It is noted that spring force of the coil spring 19 may be set by adjusting the fastening position of the fixed valve seat 17 to the body 11. That is, the spring force of the coil spring 19 may be set by adjusting the position of the axial direction of the valve body 18 by adjusting the fastening position of the fixed valve seat 17 by the thread 17*e* of the disc portion 17*a*.

Figure 2B:
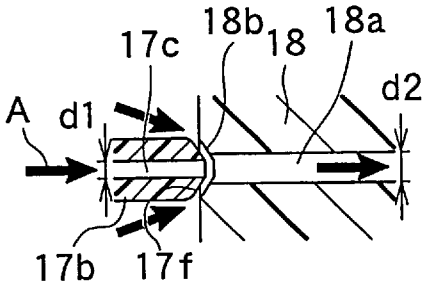
FIG. 2B is an enlarged view of showing a main part of the pressure reducer (first embodiment)

Since the pressure difference upstream and downstream of the valve body 18 acts on the valve body 18 as force in the valve opening direction and the spring force of the coil spring 19 acts on the valve body 18 as force in the valve closing direction, the valve body 18 is displaced in the axial direction to control the opening area of the inlet part of the restrict passage 18*a* so that the pressure difference is maintained at a predetermined value determined by the spring force of the coil spring 19. That is, the variable restrict valve 14 works as a constant differential pressure valve and FIG. 2B shows a state in which the valve body 18 is displaced to the side of the coil spring 19, thereby opening the valve.

The fixed restrictor 15 is formed at the most downstream end of the body 11 in the shape of a nozzle having a smooth passage contracting shape whose cross section is circular arc. Although the case of forming the fixed restrictor 15 directly at the most downstream end of the body 11 is shown in the present embodiment, the fixed restrictor 15 may be made of metal or the like separately from the body member 11 and then be combined in a body with the body 11 by the most downstream end by means of insert molding or the like. The diameter d3 of the smallest section of the fixed restrictor 15 is set to be equal with the diameter d2 of the restrict passage 18*a* of the valve body 18 (ϕ1.8 mm for example) in the present embodiment.

The intermediate space 16 causes the fixed restrictor 15 to exhibit its original restricting action by the flow rate characteristics by equalizing the flow velocity of the refrigerant by mixing the part of exhaust flow of the refrigerant whose flow velocity is high and the part whose flow velocity is low by enlarging the flow of refrigerant exhausted out of the restrict passage 18*a* of the variable restrict valve 14 at its upstream side more than the passage cross sectional area of the fixed restrictor 15 at the downstream side thereof.

Here, the diameter d4 of the intermediate space 16 is fully larger than the diameter d2 of the restrict passage 18*a* as well as the diameter d3 of the fixed restrictor 15 (around ϕ4.8 mm for example) and its length L is set to be longer than the predetermined length required for enlarging the flow of refrigerant exhausted out of the restrict passage 18*a* more than the passage cross sectional area of the fixed restrictor 15. The length L is around 40 mm in this example.

It is noted that in the structural example shown in FIG. 2, the flow of refrigerant exhausted out of the restrict passage 18*a* flows into the fixed restrictor 15 after adhering again to the inner wall face of the intermediate space 16 by the dimension setting described above (diameter d4 and length L) and by the enlarged opening portion 18*c* at the downstream end of the restrict passage 18*a*.

A filter 21 is disposed at the most upstream end of the body 11. The filter 21 catches foreign materials such as metal cutting dust and the like contained in the refrigerant to prevent the small restrict passage portion in the pressure reducer 4 from clogging. The filter 21 includes a screen 21*a* formed of resin or the like and a ringed resin frame 21*b* for supporting and fixing the screen 21*a*. The frame 21*b* is fixed to the most upstream end of the body 11 by the fitting anchoring structure or the like utilizing the elasticity of the resin.

As shown in FIG. 2A, the whole pressure reducer 4 is formed into the thin and long cylindrical shape of small diameter by arranging the filter 21, the variable restrict valve 14, the intermediate space 16 and the fixed restrictor 15 linearly on the same axial line along the flow direction A of the refrigerant.

Next, an operation of the first embodiment constructed as described above will be explained. When the compressor 1 is driven by the vehicular engine in FIG. 1, the refrigerant circulates within the refrigeration cycle, repeating the cycle of compressing the refrigerant by the compressor 1, condensing the refrigerant by the condenser 3, reducing the pressure of the refrigerant by the pressure reducer 4, evaporating the refrigerant by the evaporator 5, separating gas and liquid of the refrigerant by the accumulator 8 and suctioning the refrigerant to the compressor 1.

The operating condition changes widely in the vehicular air-conditioning refrigeration cycle like the fluctuations of discharge ability of the compressor 1 caused by the fluctuations of the speed of the vehicular engine, the fluctuations of radiating capability of the condenser 3 caused by the fluctuations of car speed and the fluctuations of cooling load of the evaporator 5 (the fluctuations of air blowing amount, the fluctuations of temperature and humidity of suctioned air) and others. Accordingly, it is important to adequately control the flow rate of the cycling refrigerant and the subcooling degree of the refrigerant at the outlet of the condenser corresponding to these cycle operating conditions in order to assure the cooling capability and to enhance the efficiency of refrigeration cycle.

Figure 3:
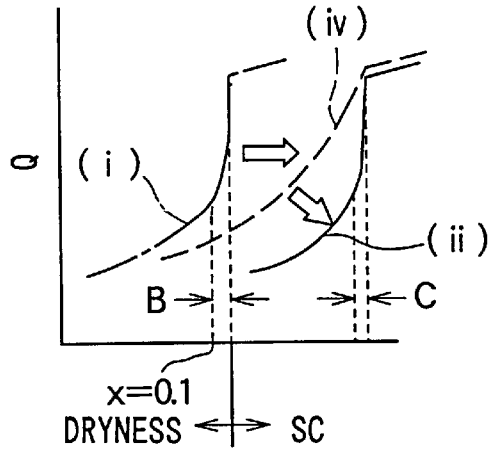
FIG. 3 is a characteristic chart of refrigerant flow rate for explaining an operation of the refrigeration cycle (first embodiment)

FIG. 3 explains the refrigerant flow rate control operation of the pressure reducer 4 according to the first embodiment, wherein the fixed restrictor 15 at the downstream side of the pressure reducer 4 is formed into the shape of a nozzle and its flow rate characteristic is characterized in that the variation of flow rate is large (flow rate control gain is large) in an area B where the dryness of the refrigerant is small (dryness $x<0.1$ for example) as shown by a dot chain line (i) in FIG. 3.

In the first embodiment, the variable restrict valve 14 as the stationary differential pressure valve is disposed at the upstream side of the fixed restrictor 15 to reduce the pressure of the refrigerant at the outlet of the condenser 3 by a predetermined value by the pressure reducing action of the variable restrict valve 14 and to flow the refrigerant in the gas and liquid two phase state and in the area where the dryness is small into the fixed restrictor 15.

This will be explained by using Mollier chart in FIG. 4. The refrigerant at the outlet of the condenser 3 is in the condition of point "a" and has predetermined subcooling degree SC. When the high-pressure liquid refrigerant having this subcooling degree SC flows into the pressure reducer 4, it is decompressed by a predetermined value ΔP by the decompressing action of the variable restrict valve 14 at first. Then, the high-pressure refrigerant is shifted to the gas-liquid two phase state (point b) having the small dryness x1. Here, because the variable restrict valve 14 plays the function of the stationary differential pressure valve, its decompression width is maintained always at the predetermined value ΔP.

Next, the refrigerant in the gas-liquid two phase state is exhausted from the restrict passage 18*a* of the valve body 18 of the variable restrict valve 14 to the intermediate space 16 and flows into the fixed restrictor 15 through the intermediate space 16. Here, the intermediate space 16 can make a flow of refrigerant having relatively uniform distribution of flow velocity by mixing the part of the flow of refrigerant exhausted out of the restrict passage 18*a* whose flow velocity is high and the part whose velocity is low.

Accordingly, since the refrigerant having the uniform distribution of flow velocity flows into the fixed restrictor 15, the flow rate characteristic shown by (i) in FIG. 3 may be exhibited reliably by the throttle action of the fixed restrictor 15. When the variable restrict valve 14 at the upstream side and the fixed restrictor 15 at the downstream side are disposed closely, the refrigerant decompressed by the variable restrict valve 14 at the upstream side flows into the fixed restrictor 15 with non-uniform distribution of flow velocity while keeping the influence of the decompression. It invites a result that it is unable to exhibit the refrigerant flow rate characteristics based on the original throttle action of the fixed restrictor 15.

Thus, the fixed restrictor 15 can perform the refrigerant flow rate control action while changing the subcooling liquid refrigerant at the outlet of the condenser 3 to the small dryness area (in the state in which the flow rate control gain is large). As a result, the flow rate control action of the fixed restrictor 15 turns out as shown by (ii) in FIGS. 3 and 5 when it is seen from the relationship with the subcooling degree of the refrigerant at the outlet of the condenser. That is, a large refrigerant flow rate control width D (FIG. 5) may be obtained by the small variation width C of the subcooling degree.

Accordingly, when the cooling thermal load of the evaporator 5 becomes large and a large refrigerant flow rate is required for example, it is possible to obtained the required refrigerant flow rate just by increasing the subcooling degree of the refrigerant at the outlet of the condenser by a small degree. It suppresses the rise of the compressor power and enhances the efficiency of the cycle operation because it can prevent the subcooling degree from becoming excessive at the time of high load and the high pressure from rising abnormally.

When the cooling thermal load of the evaporator 5 becomes small and only a small refrigerant flow rate is required in contrary, the refrigerant flow rate may be reduced to the level corresponding to the thermal load just by reducing the subcooling degree of the refrigerant at the outlet of the condenser by a small degree. It allows the highly efficient operation of the cycle to be maintained by suppressing the remarkable decrease of the subcooling degree of the refrigerant at the outlet of the condenser even when the load is low and by suppressing the reduction of enthalpy difference between the inlet and the outlet of the evaporator 5.

It is noted that although the refrigerant flow rate control action of the pressure reducer 4 has been explained above by exemplifying the fluctuations of cooling thermal load of the evaporator 5, the operating condition fluctuates remarkably in the vehicular air-conditioning refrigeration cycle by the fluctuations of the discharge capability of the compressor 1 due to the fluctuations of engine speed and the fluctuations of radiating capability of the condenser 3 due to the fluctuations of car speed as described above. Accordingly, although the condition of the refrigerant at the outlet of the condenser (subcooling degree or dryness) is apt to change largely along with the fluctuations of such operating condition in the accumulator type refrigeration cycle in FIG. 1, it is possible to deal with such fluctuations of operating condition by the first embodiment by largely changing the refrigerant flow rate by changing the subcooling degree by a small degree.

It then becomes possible by the first embodiment to maintain the variation width of the subcooling degree with respect to the fluctuations of the operating condition within a predetermined range within 7 through 15° C., for example, which is efficient in operating the cycle. It thus contributes to the enhancement of the efficiency in operating the cycle.

Figure 5:
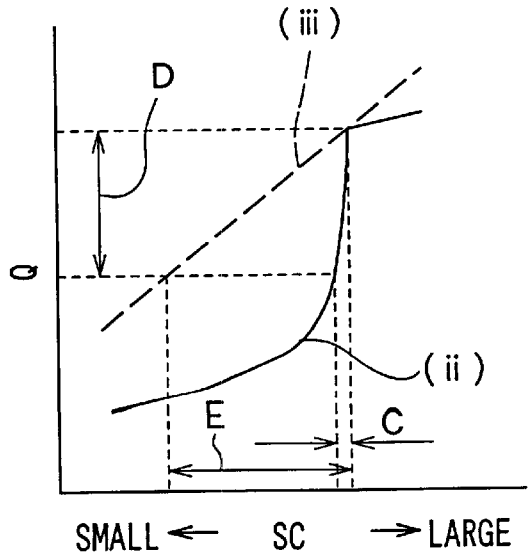
FIG. 5 is a characteristic chart of the refrigerant flow rate for explaining the operation of the refrigeration cycle (first embodiment)

A broken line (iii) in FIG. 5 indicates refrigerant flow rate control characteristics in a comparative example using only a capillary tube as a pressure reducer. The capillary tube requires a far large subcooling degree variation width E as compared to the subcooling degree variation width C described above to obtain the refrigerant flow rate control width D described above and hampers the highly efficient operation of the cycle.

Further, as it is understood from the explanation above, the decompression width is always maintained at the predetermined value ΔP because the variable restrict valve 14 works as the stationary differential pressure valve. Accordingly, it is always possible to change the refrigerant flow rate largely by changing the subcooling degree by a small degree even to the wide fluctuations of the operating condition by setting in advance the dryness of the refrigerant at the inlet of the fixed restrictor 15 so that it falls within the dryness small area B in FIG. 3 in operating in the normal load by selecting this predetermined value ΔP.

When the fixed restrictor as the capillary tube is used as upstream side throttle means of the fixed restrictor 15, an amount of pressure loss before and after the fixed restrictor changes based on the flow rate characteristics of this upstream side fixed restrictor throttle and the dryness of the refrigerant at the inlet of the downstream side fixed restrictor 15 fluctuates largely, degrading the flow rate characteristics of the downstream side fixed restrictor 15 as indicated by a broken line (iv) in FIG. 3.

The following merits may be obtained from the first embodiment because the decompression width ΔP of the variable restrict valve 14 may be controlled readily by controlling the spring force of the coil spring 19 by the thread fastening position of the stationary valve seat 17.

Figure 6:
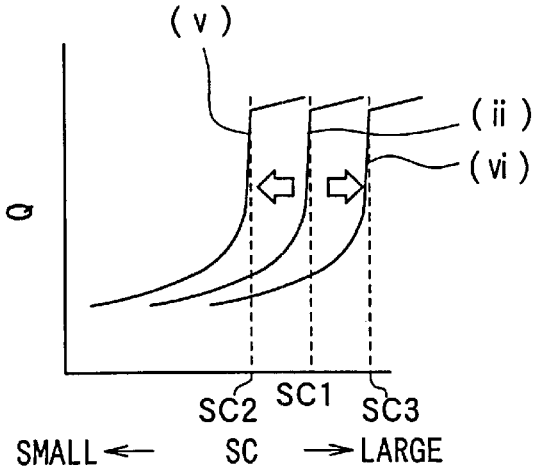
FIG. 6 is a characteristic chart of the refrigerant flow rate showing changes of subcooling degree in controlling spring preset pressure (first embodiment)

FIG. 6 is a refrigerant flow rate control characteristic chart corresponding to FIG. 5, wherein the term "spring preset pressure" is what the spring force of the coil spring 19 is expressed in terms of pressure (unit is $kg/cm^2$). (ii) in FIG. 6 is the refrigerant flow rate control characteristics by the first embodiment in FIGS. 3 and 5. (v) is the refrigerant flow rate control characteristics when the screw fastening position of the stationary valve seat 17 is moved to the left side in FIG. 2, i.e., to the side in which the spring preset pressure (spring force) of the coil spring 19 is reduced, as compared to the case of the characteristics (ii). (vi) is the refrigerant flow rate control characteristics when the screw fastening position of the stationary valve seat 17 is moved to the right side in FIG. 2, i.e., to the side in which the spring preset pressure (spring force) of the coil spring 19 is increased, as compared to the case of the characteristics (ii).

The variable restrict valve 14 is liable to open in case of the refrigerant flow rate control characteristics (v) because the spring preset pressure of the coil spring 19 decreases and the decompression width ΔP of the variable restrict valve 14 decreases due to the characteristics (ii). As a result, the cycle high pressure is balanced with the pressure lower than that of the characteristics (ii) in case of the refrigerant flow rate control characteristic (v), so that the subcooling degree of the refrigerant at the outlet of the condenser becomes a value SC2 which is smaller than SC1 in the characteristics (ii).

The restrict valve 14 is hard to open in case of the refrigerant flow rate control characteristics (vi) because the spring preset pressure of the coil spring 19 increases and the decompression width ΔP of the variable restrict valve 14 increases by the characteristics (ii). As a result, the cycle high pressure is balanced with the pressure higher than that of the characteristics (ii), so that the subcooling degree of the refrigerant at the outlet of the condenser becomes a value SC3 which is greater than SC1 in the characteristics (ii).

Thus, the subcooling degree of the refrigerant at the outlet of the condenser may be readily controlled by controlling the spring preset pressure of the coil spring 19 of the variable throttle valve 14, so that the subcooling degree may be readily controlled in the optimum range around 7 through 15° C., for example, for enhancing the efficiency of the cycle operation even when difference of heat exchanging capability occurs due to changes of size of the condenser 3 and the evaporator 5 and difference of radiating amount occurs due to changes of structure in mounting the condenser 3 in the vehicle. It is practically very convenient.

Figure 7:
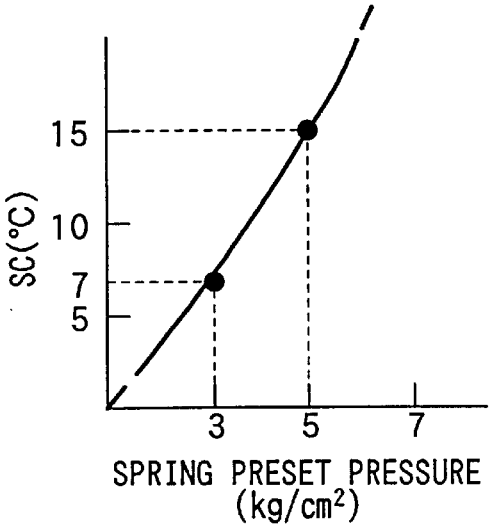
FIG. 7 is a graph of experimental data showing a relationship between the spring preset pressure and the subcooling degree (first embodiment)

Next, concrete numerical examples of the spring preset pressure of the coil spring 19 of the variable restrict valve 14 will be explained. FIG. 7 shows experimental data which has been obtained by the inventor of the present invention and which shows the relationship between the spring preset pressure of the spring 19 of the variable throttle valve 14 and the subcooling degree of the refrigerant at the outlet of the condenser. The main experimental conditions in FIG. 7 are; inlet air temperature of the condenser 3 and the evaporator 5 is 30 through 40° C. and the rotational speed of the compressor 1 is 800 through 3000 rpm.

As it is understood from FIG. 7, the subcooling degree of the refrigerant at the outlet of the condenser falls in the range of 7 through 15° C. in the range when the spring preset pressure within the range of 3 through 5 kg/cm$^2$.

The subcooling degree range of 7 through 15° C. is the optimum range in operating the refrigeration cycle from the following reasons. That is, the cycle high pressure is liable to rise excessively, thus increasing the compressor power and lowering the cycle efficiency in the state when the subcooling degree exceeds about 15° C. It is not preferable to lower the subcooling degree below about 7° C. because it is liable to reduce the difference of enthalpy between the inlet and the outlet of the evaporator 5, thus lowering the cooling capability. Thus, the subcooling degree range of 7 through 15° C. is the optimum range from the both aspects of suppressing the compressor power and of assuring the cooling capability.

Figure 8:
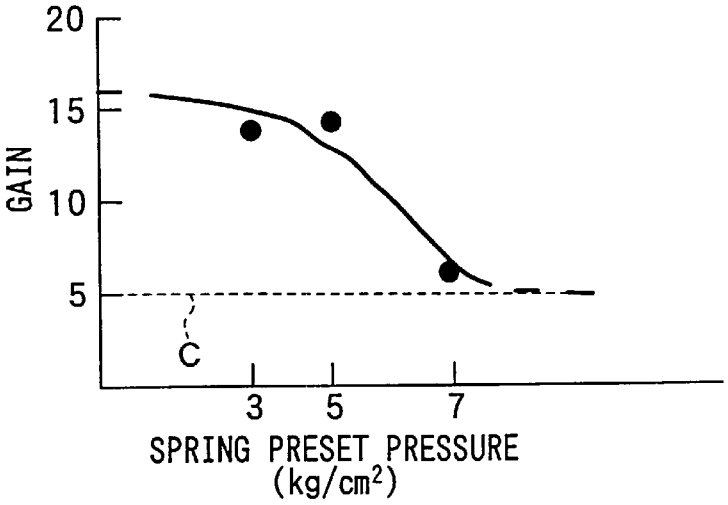
FIG. 8 is a graph of experimental data showing a relationship between the spring preset pressure and the flow rate control gain (first embodiment)
Figure 9:
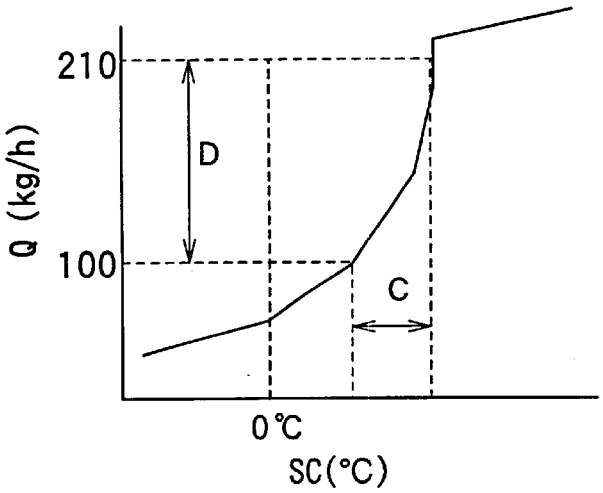
FIG. 9 is a graph for explaining a definition of the flow rate control gain in FIG. 8 (first embodiment)
Figure 10:
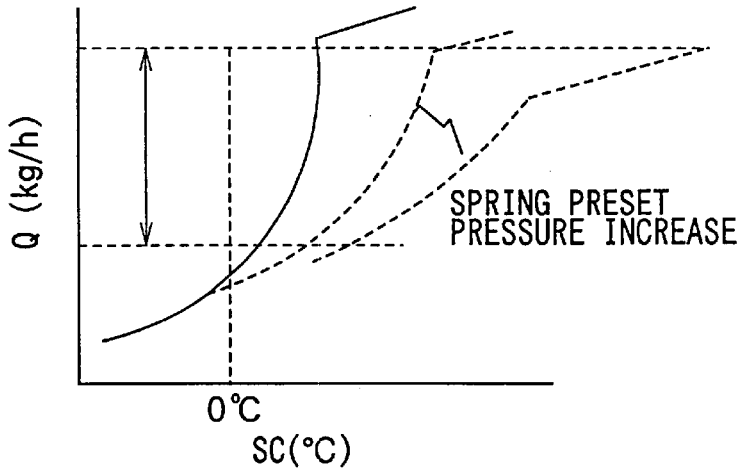
FIG. 10 is a characteristic chart of the refrigerant flow rate showing changes of subcooling degree in accordance with the spring preset pressure (first embodiment)

FIG. 8 shows the relationship between the flow rate control gain of the pressure reducer 4 having the variable restrict valve 14 and the spring preset pressure of the coil spring 19 of the variable restrict valve 14. Here, the flow rate control gain is the ratio (D/C) of the variation D of the refrigerant flow rate shown in FIG. 9 and the variation C of subcooling degree of the refrigerant at the outlet of the condenser in concrete. FIG. 10 shows changes of the flow rate control characteristics caused by the spring preset pressure and shows that the variation of flow rate with respect to the changes of the subcooling degree reduces gradually due to the increase of the spring preset pressure. It means that the flow rate control characteristics degrades due to the increase of the spring preset pressure, i.e., that the flow rate control gain reduces.

A broken line C in FIG. 8 indicates the flow rate control gain of the pressure reducer 4 composed of only the fixed restrictor 15 (having no variable restrict valve 14). The flow rate control gain is reduced to the level equal to the broken line C when the spring preset pressure exceeds 7 kg/cm$^2$. In contrary, it has been found that the flow rate control gain becomes a value (around 15) near the maximum value in the range of spring preset pressure of 3 through 5 kg/cm$^2$, exhibiting the favorable flow rate control characteristics.

Next, another feature of the first embodiment will be explained. Since the bleed port 17*c* of small diameter is formed through the cylindrical portion 17*b* of the fixed valve seat 17 of the variable restrict valve 14, the intermediate space 16 may be communicated always with the upstream passage portion 20 of the variable restrict valve 14 with a small opening by the bleed port 17*c* and the restrict passage 18*a* of the valve body 18 even when the variable restrict valve 14 is closed as shown in FIG. 2A.

However, when no bleed passage passing through the bleed port 17*c* of small diameter is provided, the variable restrict valve 14 opens even when the flow rate of the refrigerant is small. Then, the variable restrict valve 14 opens in the state when the lift (spring compression degree) of the coil spring 19 is small when the flow rate is small as indicated by a broken line (vii) in FIG. 11, the action of the coil spring 19 becomes unstable and the variable restrict valve 14 is liable to cause hunting in the opening/closing operation.

Figure 11:
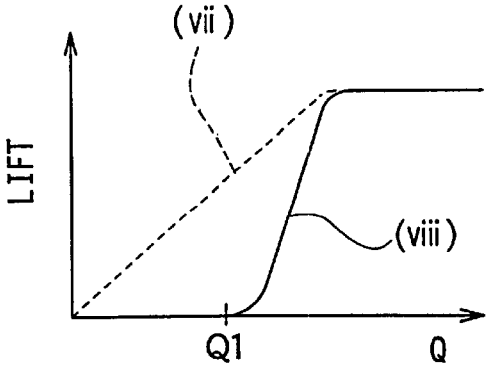
FIG. 11 is a characteristic chart showing a relation ship between a spring lift and the refrigerant flow rate for explaining the operation of the refrigeration cycle (first embodiment)

However, since the bleed passage which passes through the bleed port 17*c* is always formed in the first embodiment, the refrigerant flows through the bleed passage passing through the bleed port 17*c* and the closed state of the variable restrict valve 14 is maintained until when the refrigerant increases up to a predetermined amount Q1 (a flow rate which causes pressure loss corresponding to the predetermined value ΔP described above) as indicated by a solid line (viii) in FIG. 11. Then, when the refrigerant flow rate exceeds the predetermined amount Q1, the lift (spring compression amount) of the coil spring 19 increases suddenly and the variable restrict valve 14 opens. Therefore, it is possible to prevent the hunting of the valve opening operation caused by the small lift of the coil spring 19.

(Second Embodiment)

Figure 12:
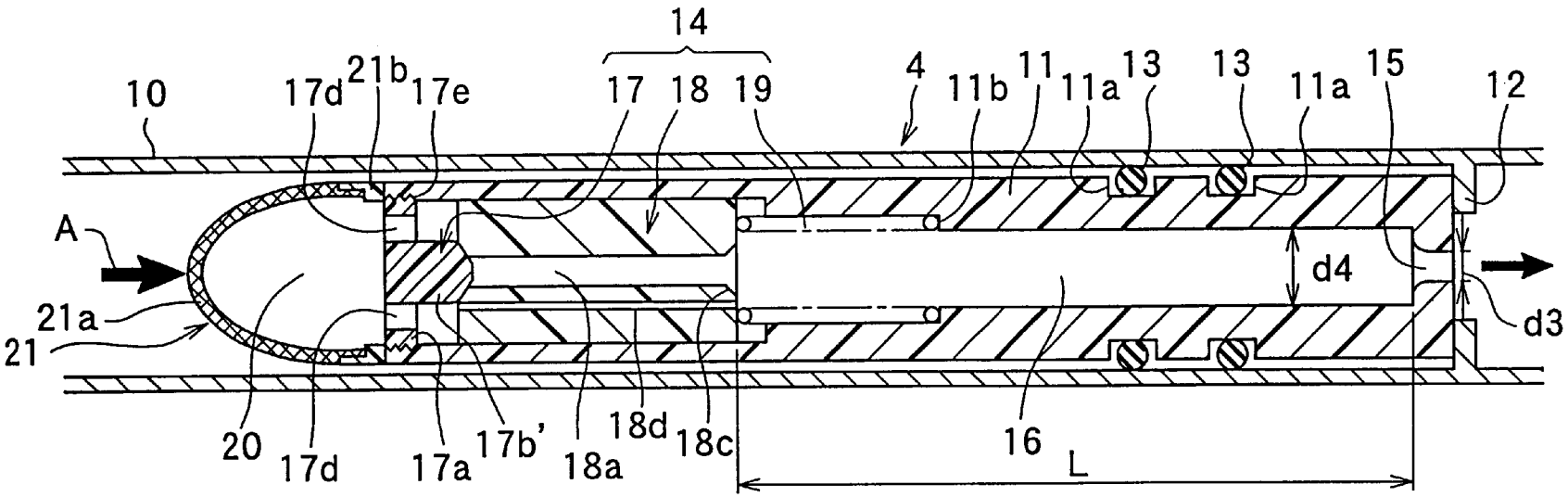
FIG. 12 is a cross-sectional view showing a pressure reducer (second embodiment)

In the first embodiment, the bleed port 17*c* of small diameter which always communicates the upstream side and the downstream side of the variable restrict valve 14 has been formed through the cylindrical portion 17*b* of the fixed valve seat 17 of the variable restrict valve 14. In the second embodiment, a bleed port 18*d* of small diameter is formed through the valve 18 of the variable restrict valve 14 as shown in FIG. 12. Thereby, the center part of the stationary valve seat 17 becomes a columnar portion 17*b*′.

According to the second embodiment, the bleed port 18*d* is provided in parallel with the restrict passage 18*a* of the valve body 18, so that the bleed port 18*d* always allows the upstream side of the variable restrict valve 14 to communicate with the downstream side thereof even when the variable restrict valve 14 (the valve body 18) is closed. Accordingly, the bleeding means of the second embodiment can exhibit the same effect with the first embodiment.

(Third Embodiment)

Figure 13:
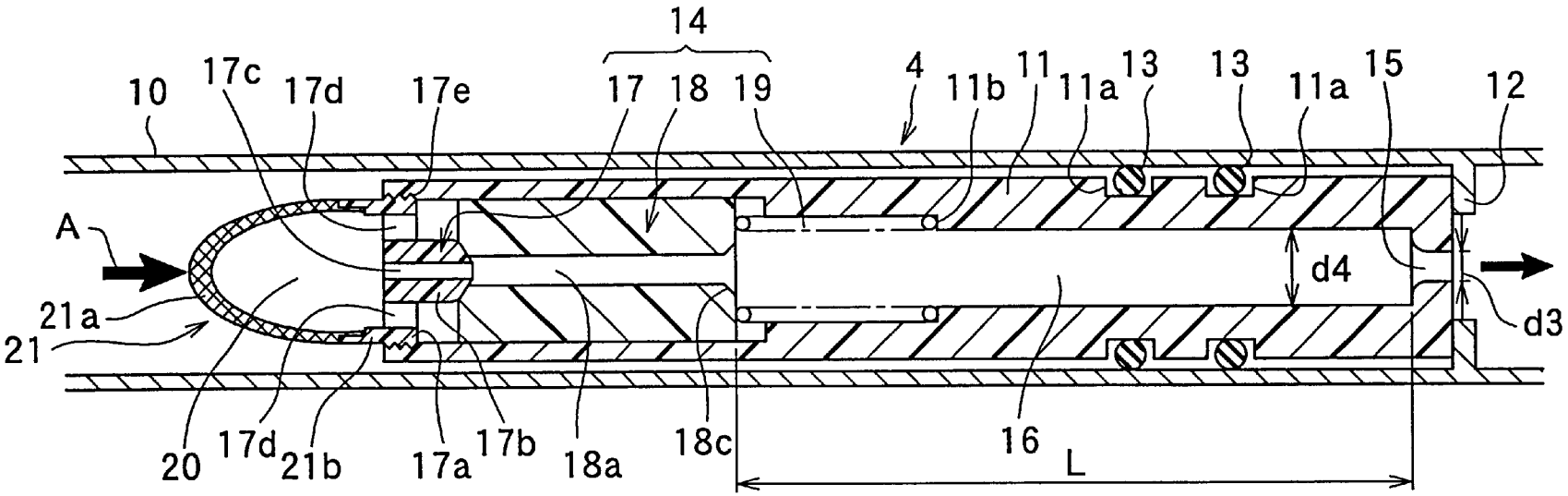
FIG. 13 is a cross-sectional view showing a pressure reducer (third embodiment)

In the first and second embodiments, the frame 21*b* of the filter 21 is fixed to the most upstream end of the body 11. In the third embodiment, a ringed resin frame 21*b* which protrudes to the upstream side of the flow of the refrigerant is formed by resin in a body with the disc portion 17*a* of the fixed valve seat 17 of the variable restrict valve 14 as shown in FIG. 13 in the third embodiment so as to support and fix the screen 21*a* by the frame 21*b*.

It allows the supporting and fixing portion of the filter 21 to be formed in a body to the fixed valve seat 17 itself and its cost reduction to be achieved by reducing a number of parts.

(Fourth Embodiment)

A fourth embodiment relates to an improvement for increasing the refrigerant flow rate control gain (refrigerant flow rate control width/ subcooling degree) with respect to changes of subcooling degree of the refrigerant at the outlet of the condenser.

Figure 14:
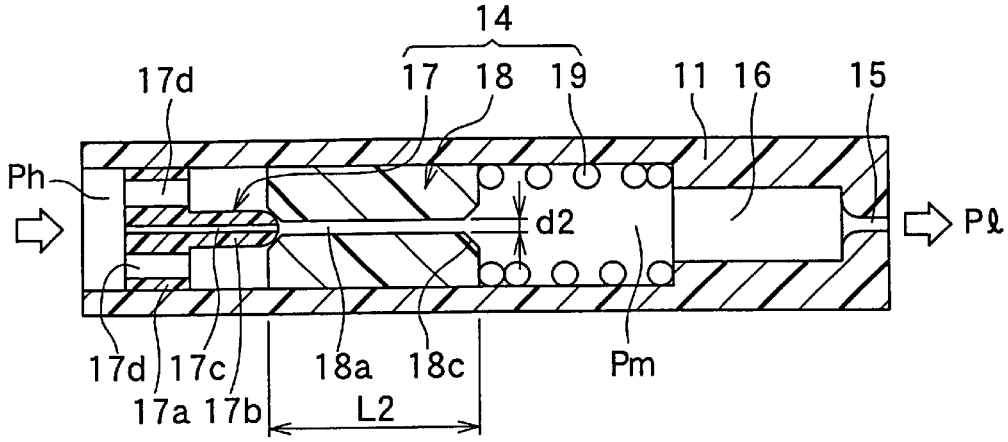
FIG. 14 is a cross-sectional view showing a main part of a pressure reducer (fourth embodiment)

FIG. 14 is an enlarged section view of the main part of the pressure reducer 4, wherein the variable restrict valve 14 works basically as the fixed differential pressure valve which keeps the differential pressure ΔP before and after the variable restrict valve 14 constant as described before. However, the differential pressure ΔP before and after the variable restrict valve 14 increases actually due to the increase of pressure loss at the variable restrict valve 14 part due to the increase of flow rate.

Figure 15:
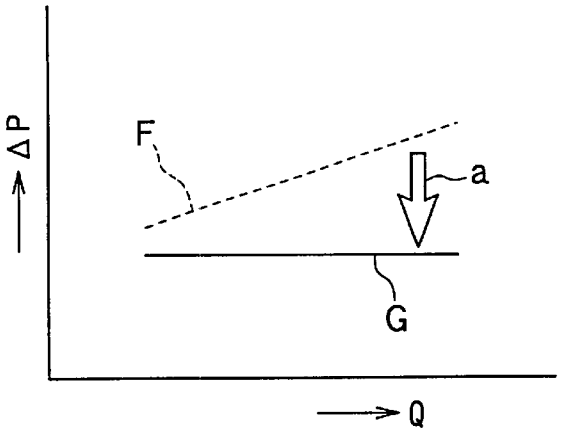
FIG. 15 is a characteristic chart showing a relationship between a refrigerant flow rate and differential pressure before and after a variable restrict valve (fourth embodiment)

FIG. 15 shows the relationship between the differential pressure ΔP before and after the variable restrict valve 14 and the refrigerant flow rate. The differential pressure ΔP is liable to increase due to the increase of flow rate as indicated by a broken line F in FIG. 15 in the general construction of the fixed differential pressure valve. Here, the general construction of the fixed differential pressure valve is the orifice type one in FIG. 18*b* described later. The differential pressure ΔP=high pressure Ph at the upstream side of the valve−pressure of intermediate part Pm. The fourth embodiment aims at the characteristic which keeps the differential pressure ΔP almost constant regardless of the variation of the refrigerant flow rate like a solid line G in FIG. 15.

Figure 4:
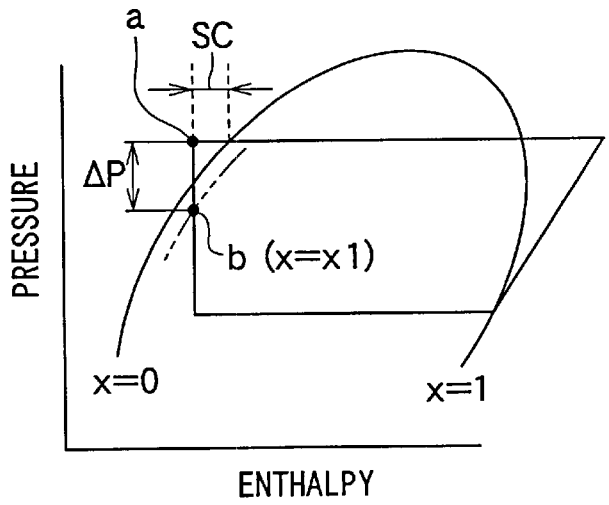
FIG. 4 is a Mollier chart for explaining the operation of the refrigeration cycle (first embodiment)

When the longitudinal differential pressure ΔP increases due to the increase of the refrigerant flow rate like a broken line F in FIG. 15, the high pressure rises and the subcooling degree SC of the refrigerant at the outlet of the condenser increases as it is apparent from Mollier chart in FIG. 4.

Figure 16:
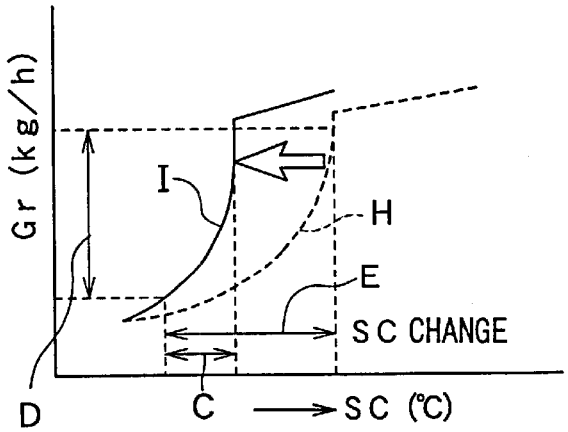
FIG. 16 is a characteristic chart showing a relationship between subcooling degree and the refrigerant flow rate at the inlet of the valve (fourth embodiment)

FIG. 16 shows the relationship between the refrigerant flow rate Gr and the subcooling degree SC of the refrigerant at the outlet of the condenser. The higher the flow rate, the larger the subcooling degree SC of the refrigerant at the outlet of the condenser becomes as indicated by a broken line H in FIG. 16 by the general construction of fixed differential pressure valve.

As a result, the refrigerant flow rate control gain (refrigerant flow rate control width D/subcooling degree variation width E) decreases (degrades) from the characteristics of the broken line H in FIG. 16.

Then, noticing on the restrict passage 18*a* of the valve body 18 in the variable restrict valve 14, the fourth embodiment obtains valve characteristics which can keep the differential pressure ΔP before and after the variable restrict valve 14 almost constant regardless of the variation of the refrigerant flow rate as indicated by the characteristic of the solid line G in FIG. 15 by causing the restrict passage 18*a* to exhibit the decompressing action by its tubular friction similarly to a capillary tube. Thereby, the refrigerant flow rate control gain (refrigerant flow rate control width D/subcooling degree variation width C) is increased like the characteristics of a solid line I in FIG. 16.

Figure 17A:
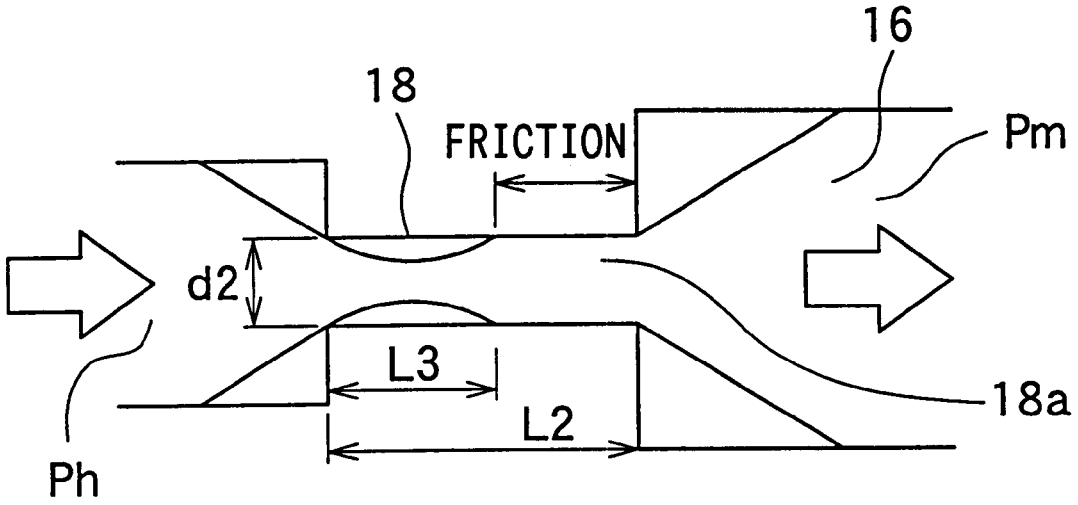
FIGS. 17A and 17B are cross-sectional views for explaining pressure-reducing action of the variable restrict valve (fourth embodiment)
Figure 17B:
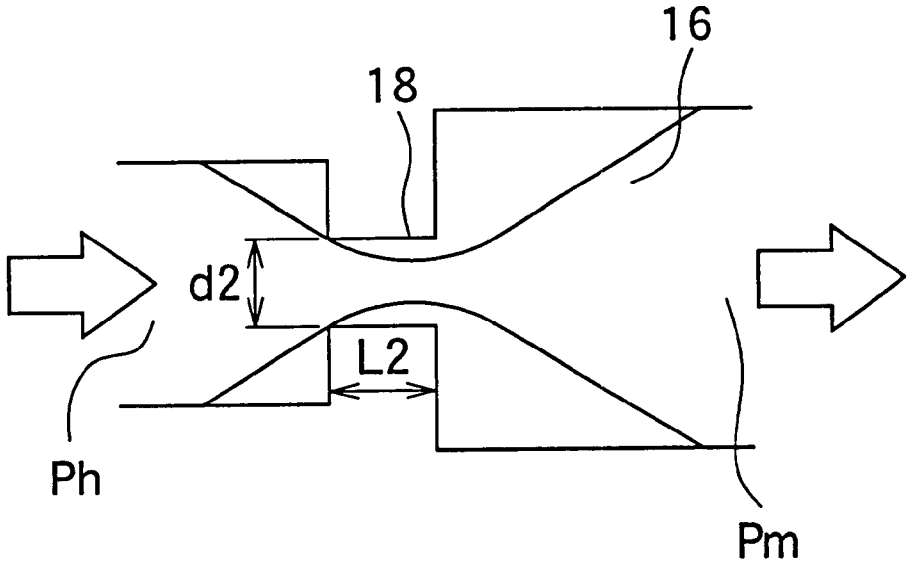

FIG. 17A shows the pressure reducing action of the variable restrict valve 14 of the fourth embodiment, and FIG. 17B shows a comparative example (in the shape of the general orifice type fixed differential pressure valve) of the fourth embodiment. In constructing the variable restrict valve 14, the restrict passage 18*a* exhibits the pressure-reducing action by its tubular friction similar to the capillary tube when the ratio of length L2 to diameter d2 is set as L2/d2>5, wherein d2 is the diameter of the restrict passage 18*a* of the valve body 18 and L2 is the length thereof.

Here, the losses of the pipe system such as an orifice include losses of sudden contraction, tubular friction and sudden expansion. In case of the shape of orifice like the comparative example of FIG. 17*b* wherein the length L2 is relatively short as compared to the diameter d2 of the restrict passage 18*a*, the flow of refrigerant which is contracted suddenly at the inlet portion of the restrict passage 18*a* flows out of the outlet portion of the restrict passage 18*a* to the intermediate space 16 while being separated from the wall surface of the restrict passage 18*a* (in other words, before the flow of refrigerant adheres again to the wall surface). As a result, no tubular frictional force acts because no pressure-reducing effect occurs due to the tubular friction at the restrict passage 18*a*.

However, according to the fourth embodiment, it is possible to set the restrict passage 18*a* having length longer than length L3 which is necessary for the flow of refrigerant separated from the wall surface of the restrict passage 18*a* by suddenly contracting at the inlet portion of the restrict passage 18*a* to adhere again to the wall surface of the passage by setting the ratio of the length L2 to the diameter d2 of the restrict passage 18*a* of the valve body 18 as (L2/d2)>5 as shown in FIG. 17*a*.

Figure 18A:
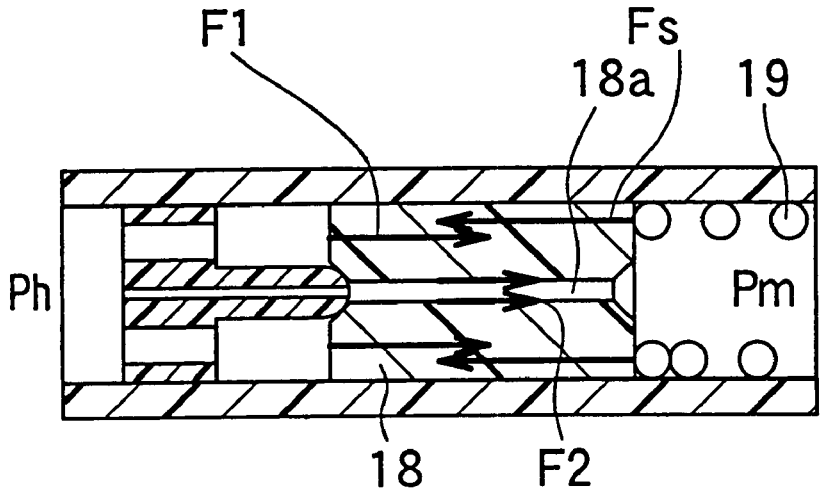
FIGS. 18A and 18B are diagrams for explaining the relationship of force balance acting on the variable restrict valve (fourth embodiment)
Figure 18B:
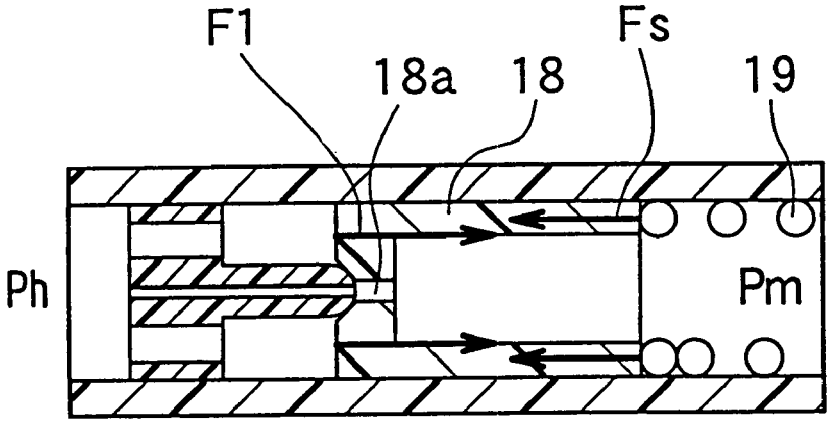

Thereby, the restrict passage 18*a* exhibits the pressure-reducing operation by the tubular friction similar to the capillary tube, so that the tubular frictional force acts on the wall surface of the restrict passage 18*a*. Then, according to the fourth embodiment, the relationship of Fs=F1+F2 holds as shown in FIG. 18*a*, where Fs is the spring force of the coil spring 19, Fl is force caused by the differential pressure ΔP before and after the valve and F2 is the tubular frictional force of the restrict passage 18*a*. Meanwhile, no tubular frictional force acts and Fs=F1 as shown in FIG. 18*b* in case of the comparative example of the orifice type.

Since the tubular frictional force F2 is proportional to the square of flow velocity, the tubular frictional force F2 becomes large when the flow rate is high. Then, the coil spring 19 is pushed in together with the valve body 18, so that the opening of the inlet portion of the restrict passage 18*a* increases. That is, according to the fourth embodiment in FIG. 15, the opening of the inlet portion of the restrict passage 18*a* increases and the differential pressure ΔP reduces due to the increase of the tubular frictional force F2 as indicated by an arrow a when the flow rate is high.

However, in case of the comparative example of the orifice type, the differential pressure ΔP increases along with the increase of the refrigerant flow rate as shown by a broken line F in FIG. 15 because the opening of the inlet portion of the restrict passage 18*a* does not increase due to the tubular frictional force F2. As a result, according to the fourth embodiment, it is possible to obtain the valve characteristics which can keep the differential pressure ΔP before and after the variable throttle valve 14 almost constant regardless of the increase of the refrigerant flow rate as indicated by a solid characteristic line G in FIG. 15. It then allows the refrigerant flow rate control gain (refrigerant flow rate control width/subcooling degree variation width) to be increased like a solid characteristic line I in FIG. 16.

Figure 19:
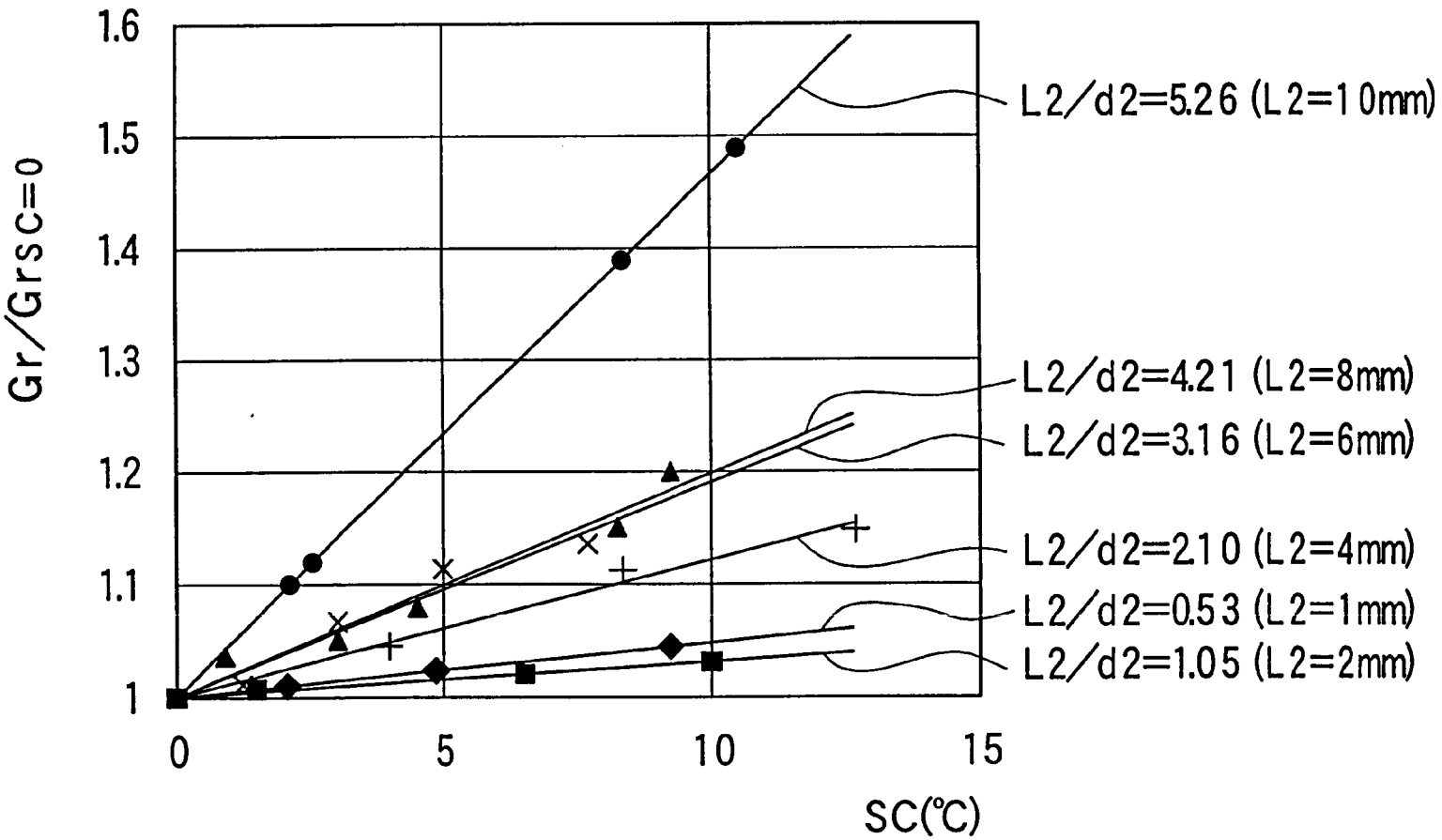
FIG. 19 is a graph of experimental data showing a relationship between subcooling degree and the refrigerant flow rate at the inlet of the valve (fourth embodiment)

FIG. 19 shows experimental data verifying the effect of improving the refrigerant flow rate control gain according to the fourth embodiment, wherein the flow rate characteristics have been evaluated by fixing the diameter of the restrict passage 18*a* as d2=φ1.9 mm and by changing the length L2 to six lengths of 1, 2, 4, 6, 8 and 10 mm. In terms of the experimental conditions, the refrigerant flow rate was measured by keeping constant the pressure (high-pressure) at the inlet of the variable restrict valve 14 as Ph=1.08 MPa, by keeping constant the pressure (low-pressure) at the outlet of the fixed restrictor 15 as P1=0.36 MPa and by using the subcooling degree SC of the refrigerant at the inlet of the variable restrict valve 14 as a parameter. Here, as an experimental object, a single orifice or capillary was used for this verifying experiment.

The refrigerant flow rate was set to be dimensionless by setting the flow rate $Gr_{sc=0}$ of the refrigerant of subcooling degree SC=0 at the inlet as 1 and is plotted in the vertical axis as refrigerant flow rate ratio. As it is understood from FIG. 19, the refrigerant flow rate may be changed to around 1.5 times by changing the subcooling degree SC=0 to 10° C. when the length L2 is 10 mm and L2/d2 is greater than 5 (fourth embodiment). However, the refrigerant flow rate changes only 1.25 times or less by changing the subcooling degree SC=0 to 10° C. in the other comparative example (one in which L2/d2 is 4.2 or less).

That is, it can be seen that the refrigerant flow rate control gain may be increased remarkably by setting (L2/d2)>5 like the fourth embodiment.

Figure 20A:
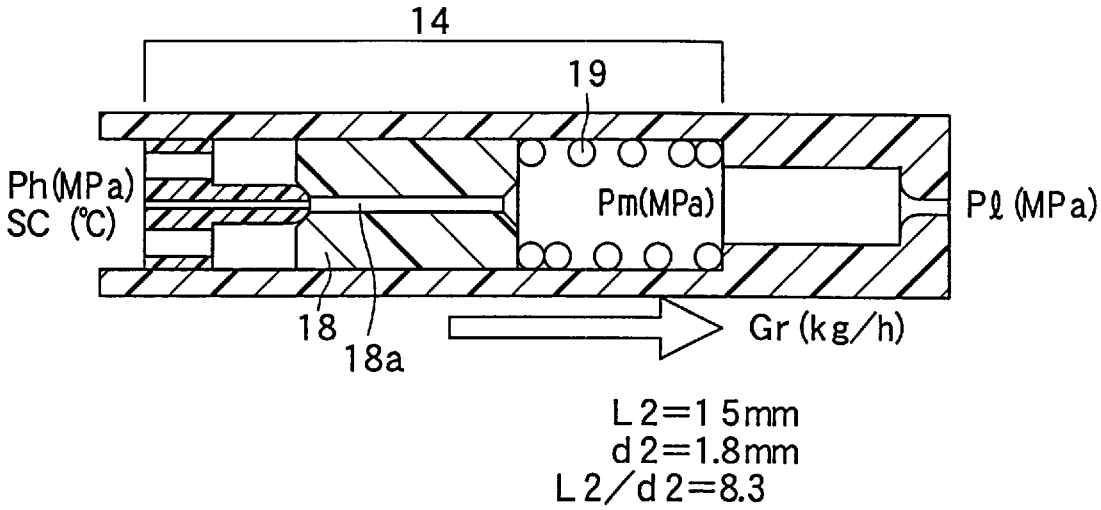
FIGS. 20A and 20B are cross-sectional view of an evaluating item used for evaluation of the refrigerant flow rate characteristics of the pressure reducer (fourth embodiment)
Figure 20B:
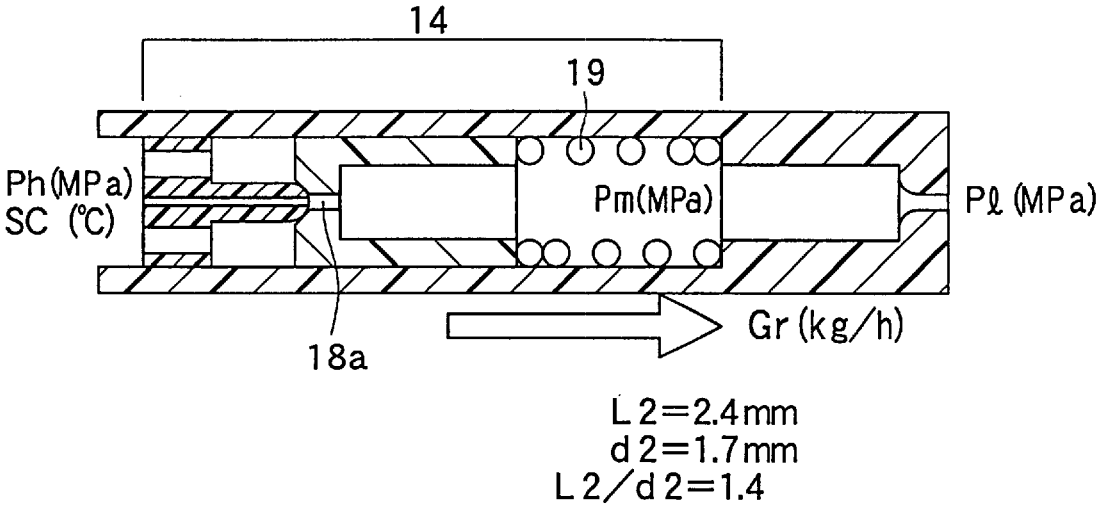

FIG. 20A shows an evaluating item (i) which was actually designed based on the fourth embodiment and FIG. 20B shows an evaluating item (ii) as a comparative case. (L2/d2)=8.3 in the evaluating item (i) and (L2/d2)=1.4 in the evaluating item (ii).

Figure 21A:
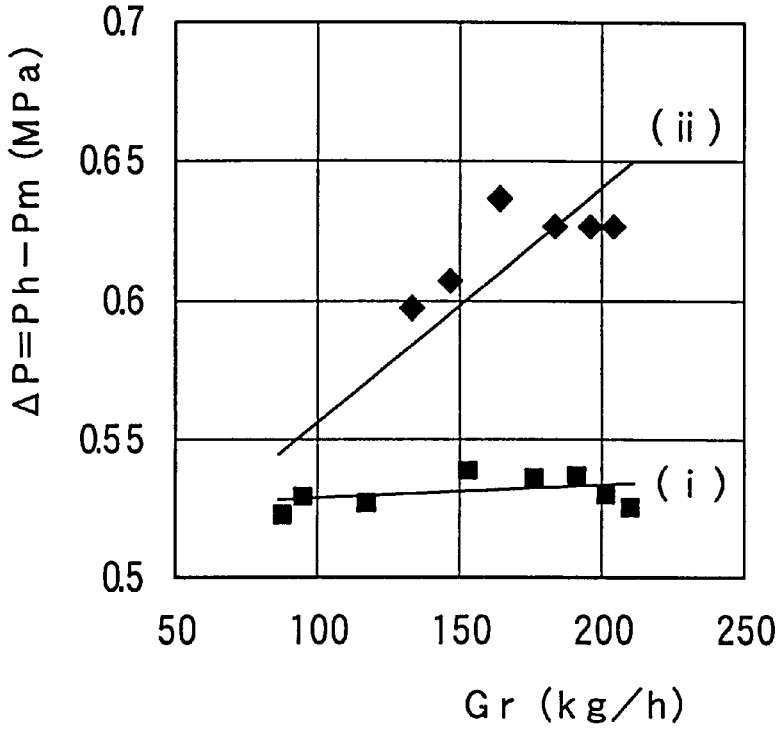
FIGS. 21A and 21B are graphs of experimental data showing the evaluation result of the refrigerant flow rate characteristics in the evaluating item in FIGS. 20A and 20B (fourth embodiment)
Figure 21B:
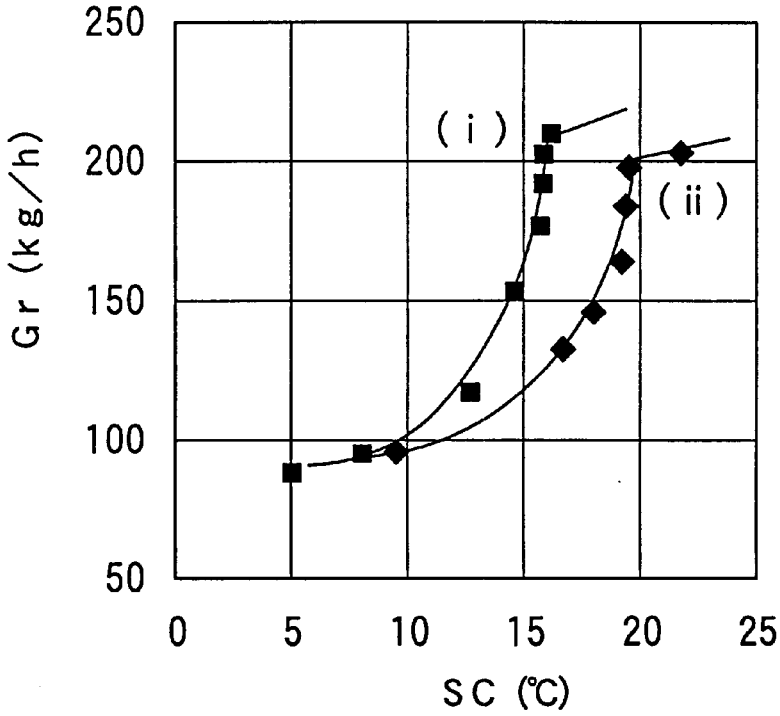
Figure 22:
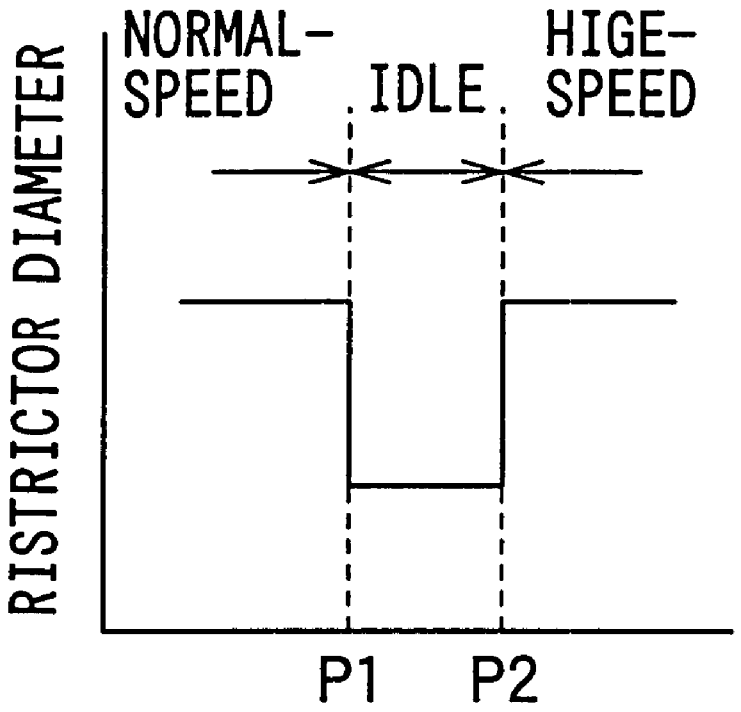
FIG. 22 PRIOR ART
FIG. 22 is a characteristic chart showing a relationship between differential pressure before and after a pressure reducer and a restrict diameter (prior art).

FIG. 21A shows changes of the differential pressure ΔP before and after the variable restrict valve 14 with respect to the changes of the refrigerant flow rate. A favorable result of being able to keep the differential pressure ΔP almost in the constant range of around 0.53 through 0.54 MPa in the evaluating item (i) to the changes of the refrigerant flow rate Gr=100 through 200 kg/h. Therefore, it is possible to suppress the variation width of the subcooling degree SC of the refrigerant at the upstream side of the variable restrict valve 14 in the relatively small range of 10 through 15° C. to the changes of the refrigerant flow rate Gr=100 through 200 kg/h by the evaluating item (i) as shown in FIG. 21B.

However, the variation width of the differential pressure ΔP with respect to the change of the refrigerant flow rate of the evaluating item (ii) becomes far greater than that of the evaluating item (i) as shown in FIG. 21A. As a result, the variation width of the subcooling degree SC of the refrigerant at the upstream side of the valve expands to the range of 10 through 20° C. with respect to the change of the refrigerant flow rate Gr=100 through 200 kg/h as shown in FIG. 21B, thus decreasing (worsening) the refrigerant flow rate control gain.

(Modifications)

It is noted that although the cases of using the fixed restrictor 15 having the shape of a nozzle as the fixed restricting at the downstream side have been explained in the embodiments described above, it is also possible to use an orifice, venturi and the like as the fixed restricting means beside the nozzle.

Further, although the cases of having the bleed ports 17*c* and 18*d* for communicating the passages before and after the variable restrict valve 14, even when the variable restrict valve 14 is closed, have been explained in the embodiments described above, a vehicular refrigeration cycle unit which automatically stops when the load condition of the cooling thermal load is low, e.g., when the outside air temperature is low, has been put into practical use. The bleed ports 17*c* and 18*d* may be eliminated in such refrigeration cycle unit because the use condition when the refrigerant flow rate becomes small is rare.

What is claimed is:

1. A pressure reducer for decompressing refrigerant, comprising:

a body member defining an intermediate space therein-side;

variable restrict means provided at a refrigerant flow upstream side of the intermediate space, said variable restrict means including a fixed valve seat and a valve body, said valve body displacing in accordance with a pressure difference between at an upstream side and a downstream side thereof; and fixed restrict means provided at a refrigerant flow downstream side of the intermediate space, into which refrigerant having passed through said variable restrict means flows, wherein passage sectional area of the intermediate space is larger than passage sectional area of said fixed restrict means, length of the intermediate space is larger than a predetermined length allowing the refrigerant injected out of said variable restrict means to expand more than the passage sectional area of said fixed restrict means, said variable restrict means has a restrict passage, and said restrict passage is formed into a shape such that the refrigerant having contracted at an inlet thereof adheres to an inner wall surface of the intermediate space to be decompressed by tubular friction.

2. A pressure reducer according to claim 1, wherein length L2 of said restrict passage and an equivalent diameter d2 of said restrict passage satisfy a relation L2/d2≧5.

3. A pressure reducer according to claim 1, wherein a restrict passage of said fixed restrict means is formed in a nozzle.

4. A pressure reducer according to claim 1, comprising a bleeding means for allowing the intermediate space to communicate with an upstream side passage of said variable restrict means even when said variable restrict means is closed.

5. A pressure reducer according to claim 4, wherein said bleeding means is formed within said fixed valve seat.

6. A pressure reducer according to claim 4, wherein said bleeding means is formed within said valve body.

7. A pressure reducer according to claim 1, further comprising:

spring means for urging said valve body toward a valve closing direction against the pressure difference, wherein a spring force of said spring means is adjustable.

8. A pressure reducer according to claim 7, wherein said fixed valve seat is assembled to said body member so that a position of which can be adjusted and the spring force of said spring means is adjusted by adjusting the position of said fixed valve seat.

9. A pressure reducer according to claim 7, wherein the spring force of said spring means is preset at 3–5 kg/cm$^2$.

10. A pressure reducer according to claim 1, further comprising a filter disposed at the upstream side of said variable restrict means.

11. A pressure reducer according to claim 10, wherein said fixed valve seat is disposed at the upstream side of said valve body, and said filter is integrally attached to said fixed valve seat.

12. A pressure reducer according to claim 1, wherein said body member is cylindrically formed, and said variable restrict means and said fixed restrict means are contained linearly on a same axial line in said body member.

13. A refrigeration cycle unit, comprising:

a compressor for compressing and discharging refrigerant;

a condenser for condensing the refrigerant from said compressor;

a pressure reducer for decompressing the refrigerant from said condenser;

an evaporator for evaporating the refrigerant decompressed by said pressure reducer; and an accumulator for storing the refrigerant from said evaporator, and separating gas phase refrigerant from liquid phase refrigerant, wherein said pressure reducer includes a body member defining an intermediate space thereinside, variable restrict means provided at a refrigerant flow upstream side of the intermediate space in said body member, said variable restrict means includes a fixed valve seat and a valve body, said valve body displaces in accordance with a pressure difference between at an upstream side and a downstream side thereof, and fixed restrict means provided at a refrigerant flow downstream side of the intermediate space in said body member, into which refrigerant having passed through said variable restrict means flows, passage sectional area of the intermediate space is larger than passage sectional area of said fixed restrict means, length of the intermediate space is larger than a predetermined length allowing the refrigerant injected out of said variable restrict means to expand more than the passage sectional area of said fixed restrict means, said variable restrict means has a restrict passage, and said restrict passage is formed into a shape such that the refrigerant having contracted at an inlet thereof adheres to an inner wall surface of the intermediate space to be decompressed by tubular friction.

14. A refrigeration cycle unit according to claim 13, wherein said compressor is driven by a vehicular engine, said condenser is disposed at a region where it is cooled by receiving running wind in running the vehicle, and said evaporator cools air blown out to a car room.

* * * * *